US009758223B1

(12) United States Patent
Gagno

(10) Patent No.: US 9,758,223 B1
(45) Date of Patent: Sep. 12, 2017

(54) BLU WATER LIFT SYSTEMS

(71) Applicant: Blu Alexander Gagno, Brechin (CA)

(72) Inventor: Blu Alexander Gagno, Brechin (CA)

( * ) Notice: Subject to any disclaimer, the term of this patent is extended or adjusted under 35 U.S.C. 154(b) by 0 days.

(21) Appl. No.: 15/067,637

(22) Filed: Mar. 11, 2016

(51) Int. Cl.
*B63C 3/12* (2006.01)
*B63C 3/06* (2006.01)

(52) U.S. Cl.
CPC . *B63C 3/12* (2013.01); *B63C 3/06* (2013.01)

(58) Field of Classification Search
USPC ..... 114/259
See application file for complete search history.

(56) References Cited

U.S. PATENT DOCUMENTS 4,878,450 A 11/1989 Schmidt
4,900,051 A * 2/1990 Godbersen ..... B60P 3/1033 280/414.1
5,090,841 A 2/1992 Penick et al.
6,003,463 A 12/1999 Giesler
6,289,837 B1 * 9/2001 Stetzel ..... B63B 23/32 114/259
6,327,992 B1 12/2001 Martin
6,474,256 B1 * 11/2002 Vogel ..... B63B 23/32 114/259
6,786,170 B2 9/2004 Trowbridge
2013/0087986 A1 * 4/2013 Stansfield ..... B60P 3/1066 280/162

* cited by examiner

*Primary Examiner* — Kyle Armstrong
(74) *Attorney, Agent, or Firm* — Integrity Patent Group, PLC; Edwin Wold

(57) ABSTRACT

A blu water lift system for personal watercraft docking systems to raise and lower a personal watercraft into water and retain the personal watercraft for transport. The blu water lift system may be removably attached to boat and a remote activator can be used to manipulate a watercraft between an in-transport condition and a non-transport condition. The blu water lift system may include a carriage structure with a hull-resting plate, at least one carriage rail and at least one pivot mounting arm with at least one bracket assembly, attachment means, and electrically-operated actuator. The blu water lift assembly may be used to removably attach a frame and a carriage structure to a watercraft, operating the at least one pivot mounting arm and operating a loading ramp. Blu water lift systems may be made of corrosion-resistant materials to promote longevity in water-environments.

18 Claims, 5 Drawing Sheets

BLU WATER LIFT SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. Field of the Invention

The present invention relates generally to the field of personal watercraft docking systems and more specifically relates to blu water lift systems.

2. Description of Related Art

Using a personal watercraft is a favorite past time for many people. Personal watercraft can frequently be seen while being used in the ocean or on lakes. A personal watercraft may be defined as a water-use vehicle that a rider sits or stands on (rather than inside of, as in a boat) and is typically less than 13 feet in length. Typically, personal watercraft have an inboard engine that drives a pump jet with a screw-shaped impeller to create thrust for both propulsion and steering. Due to the speed and maneuverability characteristics that personal watercraft possess, the military and some police departments use personal watercraft for patrol and enforcement activities.

Generally, personal watercraft are used in relatively small geographic areas or bodies of water and need a transport method to allow them to be moved to different locations. Over land, a small, wheeled trailer may be attached to a land vehicle, and the personal watercraft may be placed on the trailer and towed behind the land vehicle. If the user is also transporting a small boat to the location, then a second vehicle and an additional boat trailer may be needed, as well. Often, a pleasure boat may be used to transport the personal watercraft. In this case, a device is required to store and transport the personal watercraft, as well as provide a means to launch and retrieve the personal watercraft to and from the water. Launching systems, which may include hydraulic lifting mechanisms, can be complex and subject to reliability issues that relate to the operation of complex machines. A suitable solution is desired.

Several attempts have been made to solve the above-mentioned problems such as those found in U.S. Pat. No. 6,003,463 to Giesler, U.S. Pat. No. 4,878,450 to Schmidt, U.S. Pat. No. 6,327,992 to Martin, U.S. Pat. No. 6,786,170 to Trowbridge, and U.S. Pat. No. 5,090,841 to Penick, et. al. This art is representative of personal watercraft docking systems. However, none of the above inventions and patents, taken either singly or in combination, is seen to describe the invention as claimed.

Preferably, a personal watercraft docking system should provide a device to raise and lower a personal watercraft into water and to hold the personal watercraft for transport and, yet would operate reliably and be manufactured at a modest expense. Thus, a need exists for a reliable blu water lift system to avoid the above-mentioned problems.

BRIEF SUMMARY OF THE INVENTION

In view of the foregoing disadvantages inherent in the known personal watercraft docking system art, the present invention provides a novel blu water lift system. The general purpose of the present invention, which will be described subsequently in greater detail is to provide a device to raise and lower a personal watercraft into water and to hold the personal watercraft for transport.

Generally speaking, blu water lift system is designed to lift a personal watercraft or a tender (up to 1500 lbs and up to 12.5 feet in length) out of the water for transport on the back of a boat for easy transport and easy storage. The blu water lift system is easy to operate. First, attach the winch hook from the blu water lift system to the watercraft. Second, use the remote activator to raise the personal watercraft to the fold down loading ramp and the winch will pull the watercraft toward the nose tower until the hull is adjacent to the nose cradle. The remote activator may further be used to elevate the blu water lift system adjacent to the swim platform of a boat. The supports and struts are adjustable to fit most styles of boat swim platforms. Hardware and supports are made out of stainless steel and the rack system and adjustable underwater struts are made out of aluminum or double walled aluminum, as per design.

The blu water lift assembly may be useful for removably attaching the frame and the carriage structure to the watercraft, operating the at least one pivot mounting arm via the electrically-operated actuator and the remote activator, and operating the loading ramp for manipulating the watercraft between the in-transport condition and a non-transport condition.

A blu water lift system comprises a blu water lift assembly, which may comprise a frame, a carriage structure, at least one pivot mounting arm, an electrically-operated actuator, a loading ramp, and a remote activator. The frame may comprise a square-beam, which may further comprise a first-end and a second-end, useful for providing structure to attach the nose tower and the carriage structure. The second-end may comprise a nose tower, which may further comprise a winch receiver, a hook receiver, and a nose cradle. The nose cradle may comprise at least one cushioned bumper. The nose tower may comprise at least one horizontal position useful for accommodating varying lengths of at least one watercraft. The blu water lift assembly may further comprise corrosion-resistant materials to promote longevity in water-environments.

The carriage structure may comprise a hull-resting plate and at least one carriage rail, which may further comprise a spar in preferred embodiments. The at least one carriage rail may be useful for retaining a hull of a watercraft during an in-transport condition. The carriage structure may comprise a left carriage rail and a right carriage rail, The left carriage rail may comprise a forward bracket assembly and a rear bracket assembly. The right carriage rail may comprise a forward truss and a rear truss. The forward truss and the rear truss may comprise members in perpendicular arrangement.

The spar may comprise at least one cushioned roller, at least one truss assembly, and at least one pivot mounting arm. The at least one pivot mounting arm may comprise at least one bracket assembly, an attachment means useful for raising and lowering a watercraft, an electrically-operated actuator, and a loading ramp. The at least one pivot mounting arm may comprise a front pivot arm and a rear pivot arm. The front pivot arm may comprise a first rotation mechanism useful for providing up to 25 degrees range of vertical motion for the carriage structure. The rear pivot arm may comprise a second rotation mechanism useful for providing up to 25 degrees range of vertical motion for the carriage structure. The rear pivot arm may comprise load-bearing materials suitable for carrying a load of the watercraft.

The loading ramp may comprise a ladder structure, which may further may a hinged attacher useful for maneuvering the watercraft to the carriage structure. The ladder structure may also comprise at least one cushioned disk.

The remote activator may comprise system on activation, system off activation, system raise activation, and system lower activation. The remote activator may further comprise RF operating signals.

The blu water lift system may comprise a kit including: the blu water lift assembly, attachment means, and a set of user instructions. A method of using a blu water lift system may comprise the steps of installing front pivot arm and rear pivot arm of a blu water lift system to a boat, loading a watercraft; and unloading a watercraft when desired.

The present invention holds significant improvements and serves as a personal watercraft docking system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, blu water lift systems, constructed and operative according to the teachings of the present invention.

The various embodiments of the present invention will hereinafter be described in conjunction with the appended drawings, wherein like designations denote like elements.

DETAILED DESCRIPTION

As discussed above, embodiments of the present invention relate to a personal watercraft docking system and more particularly to a blu water lift system as used to improve the device to raise and lower a personal watercraft into water and to retain the personal watercraft for a transport condition.

Figure 1:
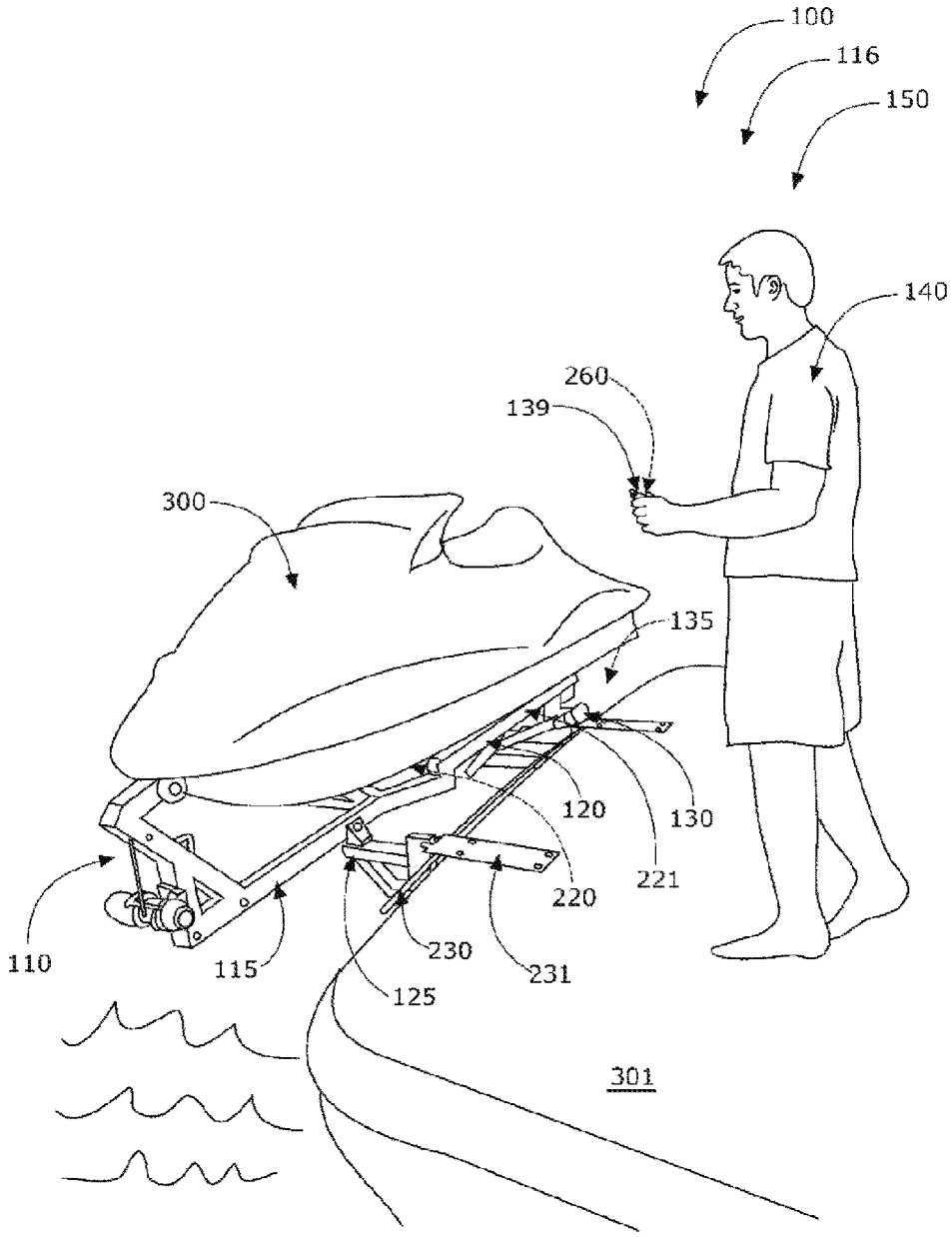
FIG. 1 shows a perspective view illustrating a blu water lift system during an 'in-use' condition showing the blu water lift assembly according to an embodiment of the present invention.

Referring to the drawings by numerals of reference there is shown in FIG. 1, a perspective view illustrating blu water lift system 100 during 'in-use' condition 150 showing blu water lift assembly 110 which may be removably attached to boat 301 and user 140 may use electrically-operated actuator 130 and remote activator 139 to manipulate watercraft 300 between an in-transport condition and a non-transport condition. Remote activator 139 may comprise RF operating signal 260. Blu water lift system 100 may comprise carriage structure 120 which may further may comprise hull-resting plate 220, at least one carriage rail 221 and at least one pivot mounting arm 125. At least one pivot mounting arm 125 may comprise at least one bracket assembly 230, attachment means 231, and electrically-operated actuator 130.

In continuing to refer to FIG. 1, blu water lift assembly 110 may be useful for removably attaching frame 115 and carriage structure 120 to watercraft 300, operating at least one pivot mounting arm 125 via electrically-operated actuator 130 and remote activator 139, and operating loading ramp 135. Blu water lift system 100 may comprise corrosion-resistant materials 116 to promote longevity in water-environments.

Figure 2A:
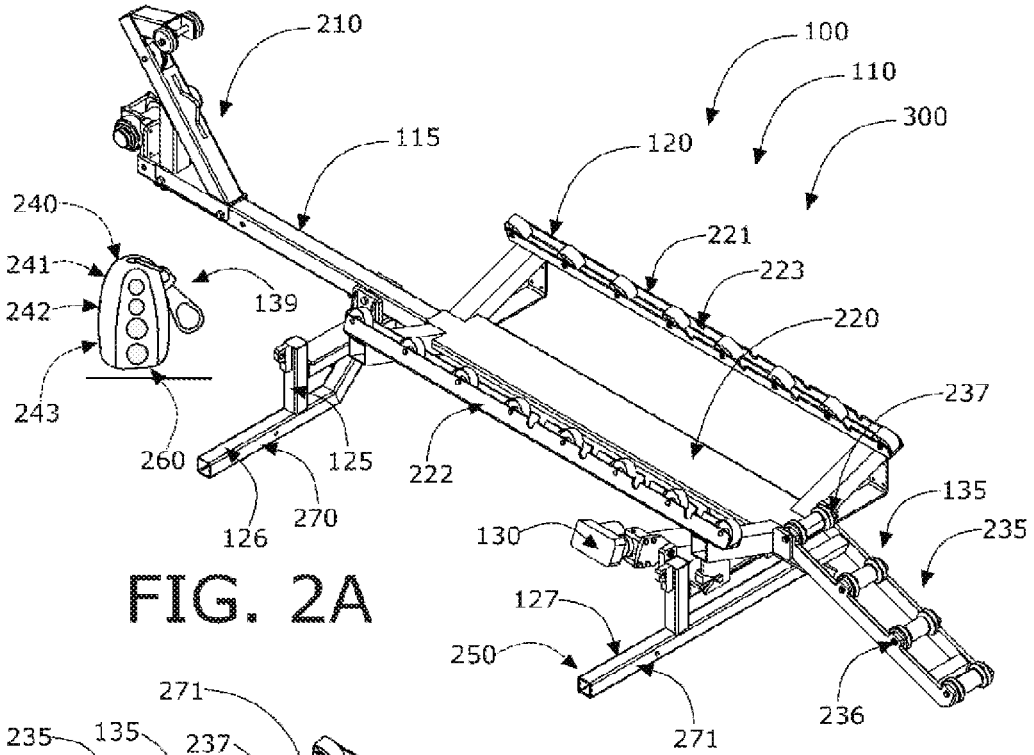
FIG. 2A is a perspective view illustrating the blu water lift system comprising the blu water lift assembly according to an embodiment of the present invention of FIG. 1.
Figure 2B:
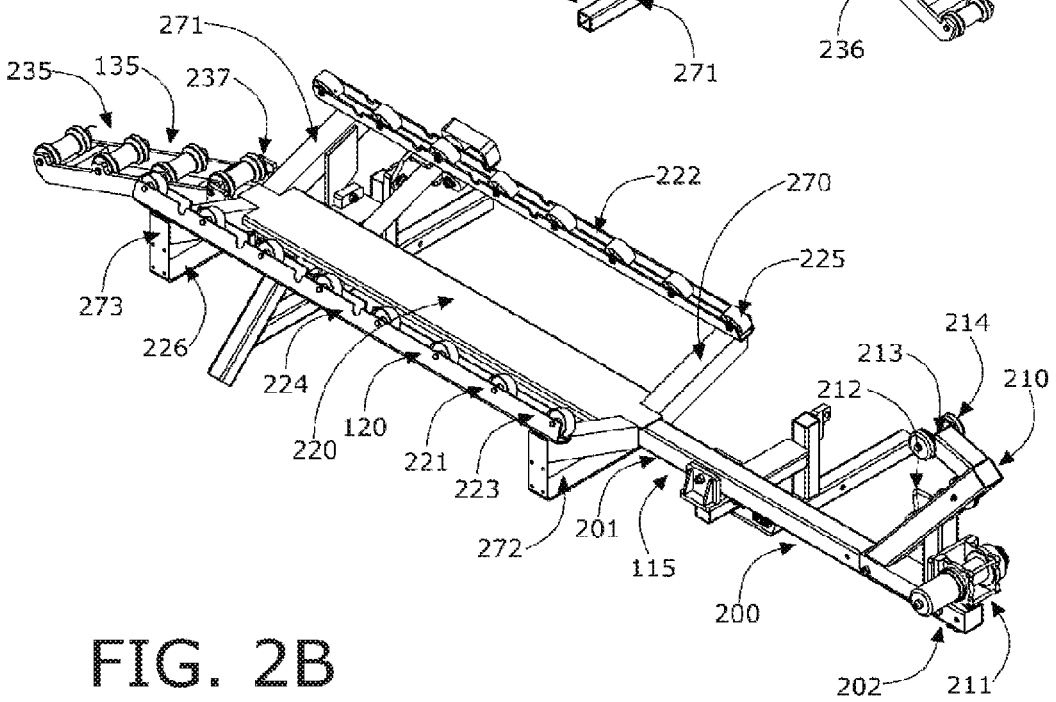
FIG. 2B is a perspective view illustrating the blu water lift system comprising the blu water lift assembly according to an embodiment of the present invention of FIG. 1.

Referring now to FIGS. 2A and 2B showing blu water lift system 100 in perspective views; FIG. 2A showing left-side and rear perspective view of blu water lift system 100 which may comprise blu water lift assembly 110. Blu water lift assembly 110 may comprise in structural combination frame 115, nose tower 210, carriage structure 120, at least one pivot mounting arm 125, electrically-operated actuator 130, loading ramp 135, and remote activator 139. Further, at least one pivot mounting arm 125 may comprise a front pivot arm 126 and a rear pivot arm 127. Rear pivot arm 127 may comprise load-bearing materials 250 suitable for carrying a load of watercraft 300.

In continuing to refer to FIG. 2A, carriage structure 120 may comprise hull-resting plate 220 and at least one carriage rail 221 useful for retaining a hull of a watercraft 300 during an in-transport condition. Carriage structure 120 may comprise a left carriage rail 222 and a right carriage rail 223. Blu water lift system 100 may comprise loading ramp 135 which may further comprise ladder structure 235 and hinged-attacher 237, useful for maneuvering watercraft 300 to carriage structure 120. Ladder structure 235 may comprise at least one cushioned disk 236. Further, blu water lift system 100 remote activator 139 may comprise system on activation 240, system off activation 241, system raise activation 242, and system lower activation 243. Remote activator 139 may comprise RF operating signal 260. Upon reading this specification, it should be appreciated that, under appropriate circumstances, considering such issues as user preferences, design preference, structural requirements, marketing preferences, cost, available materials, technological advances, etc., other operating signal arrangements such as, for example, short-range wireless interconnection operating signal or mobile device application, etc., may be sufficient.

Referring now to FIG. 2B showing right-side and front perspective view of blu water lift assembly 110 which may comprise frame 115. Frame 115 may comprise square-beam 200 in preferred embodiments, other profiles may be used in alternate embodiments. Square-beam 200 may comprise first-end 201 and second-end 202. Second-end 202 may comprise nose tower 210. Nose tower 210 may comprise winch receiver 211, hook receiver 212, and nose cradle 213. Nose cradle 213 may further comprise at least one cushioned bumper 214.

In continuing to refer to FIG. 2B, carriage structure 120 may comprise hull-resting plate 220 and at least one carriage rail 221 useful for retaining hull of a watercraft 300 during an in-transport condition. Carriage structure 120 may comprise left carriage rail 222 and right carriage rail 223. Left carriage rail 222 may comprise forward bracket assembly 270 and rear bracket assembly 271. Right carriage rail 223 may comprise forward truss 272 and rear truss 273. Forward truss 272 and rear truss 273 may comprise members in perpendicular arrangement.

Referring further to FIG. 2B, at least one carriage rail 221 may comprise spar 224. Spar 224 may comprise at least one cushioned roller 225 and at least one truss assembly 226. Blu water lift assembly 110 may further comprise loading ramp 135 which may comprise ladder structure 235 and hinged-attacher 237.

Figure 3:
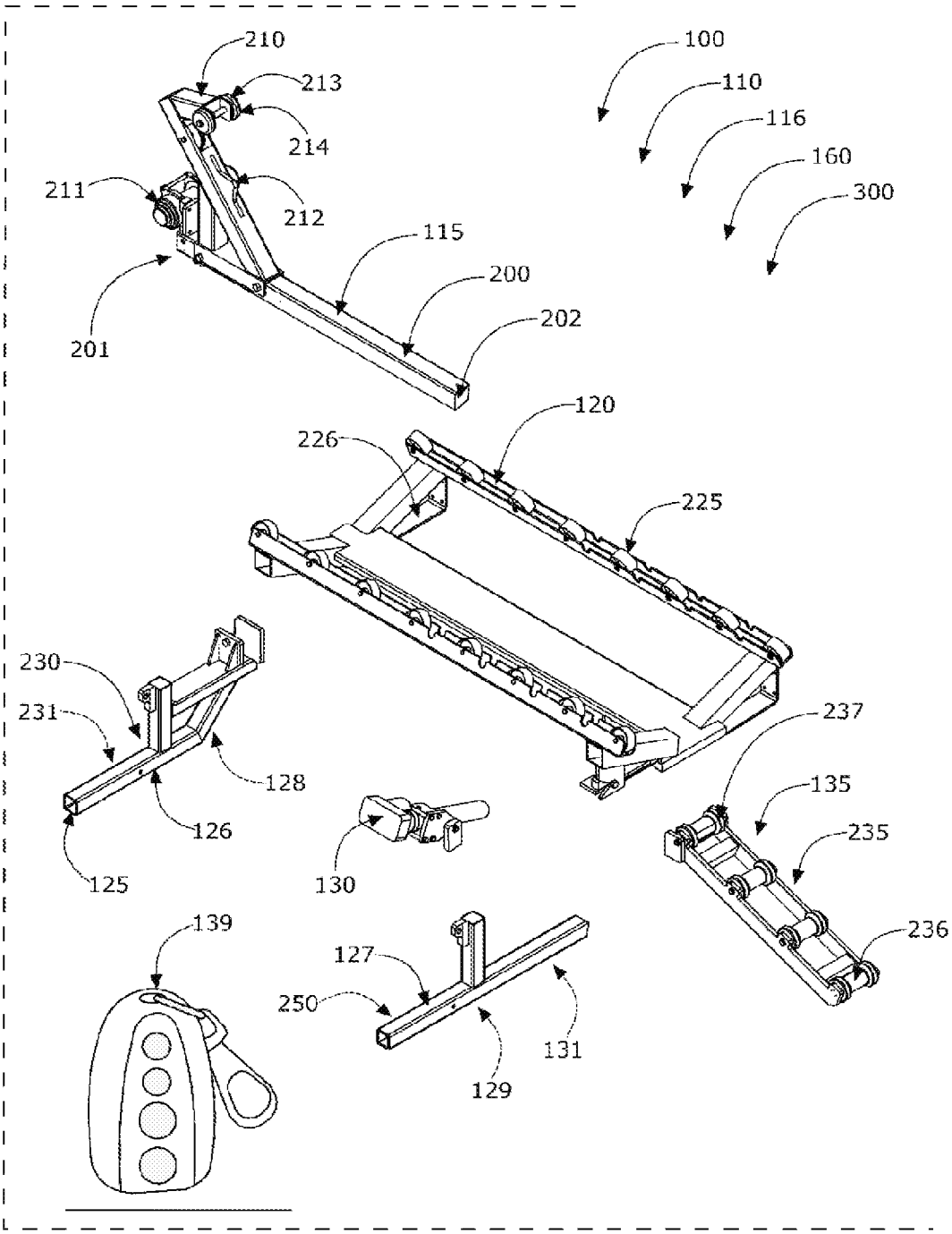
FIG. 3 is an exploded perspective view illustrating the blu water lift system according to an embodiment of the present invention of FIGS. 1-2.

Referring now to FIG. 3, an exploded view of blu water lift system 100 which may comprise in structural combination frame 115, carriage structure 120, at least one pivot mounting arm 125, electrically-operated actuator 130, loading ramp 135, and remote activator 139. Blu water lift assembly 110 may comprise corrosion-resistant materials 116 to promote longevity in water-environments. Blu water lift assembly 110 may comprise frame 115 which may further comprise square-beam 200. Square-beam 200 may comprise first-end 201 and second-end 202 useful for providing structure to attach nose tower 210 and carriage structure 120. Blu water lift system 100 carriage structure 120 may comprise at least one cushioned roller 225 and at least one truss assembly 226. Nose tower 210 may comprise winch receiver 211, hook receiver 212, and nose cradle 213. Nose cradle 213 may comprise at least one cushioned bumper 214. Nose tower 210 may comprise at least one horizontal position useful for accommodating varying lengths of watercraft 300.

In continuing to refer to FIG. 3, at least one pivot mounting arm 125 may comprise at least one bracket assembly 230 and attachment means 231, which may be useful for raising and lowering a watercraft 300. At least one pivot mounting arm 125 may comprise a front pivot arm 126 and a rear pivot arm 127. Front pivot arm 126 may comprise first-rotation mechanism 128 useful for providing up to 25 degrees range of vertical motion for carriage structure 120. Rear pivot arm 127 may comprise second-rotation mechanism 129 useful for providing up to 25 degrees range of vertical motion for carriage structure 120. Further, at least one pivot mounting arm 125 may comprise at least one bracket assembly 230 and attachment means 231 may be useful for raising and lowering a watercraft 300. Rear pivot arm 127 may comprise load-bearing materials 250 suitable for carrying a load of watercraft 300. Blu water lift assembly 110 may be useful for removably attaching frame 115 and carriage structure 120 to watercraft 300, operating at least one pivot mounting arm 125 via electrically-operated actuator 130 and remote activator 139, and operating loading ramp 135 for manipulating watercraft 300 between in-transport condition and a non-transport condition.

In further referring to FIG. 3, loading ramp 135 may comprise ladder structure 235 and hinged-attacher 237 useful for maneuvering watercraft 300 to carriage structure 120. Ladder structure 235 may further comprise at least one cushioned disk 236. Blu water lift system 100 may be sold as kit 160 comprising the following parts: at least one blu water lift assembly 110; at least one fastening means 131; and at least one set of user instructions. The kit has instructions such that functional relationships are detailed in relation to the structure of the invention (such that the invention can be used, maintained, or the like in a preferred manner). Blu water lift system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 4:
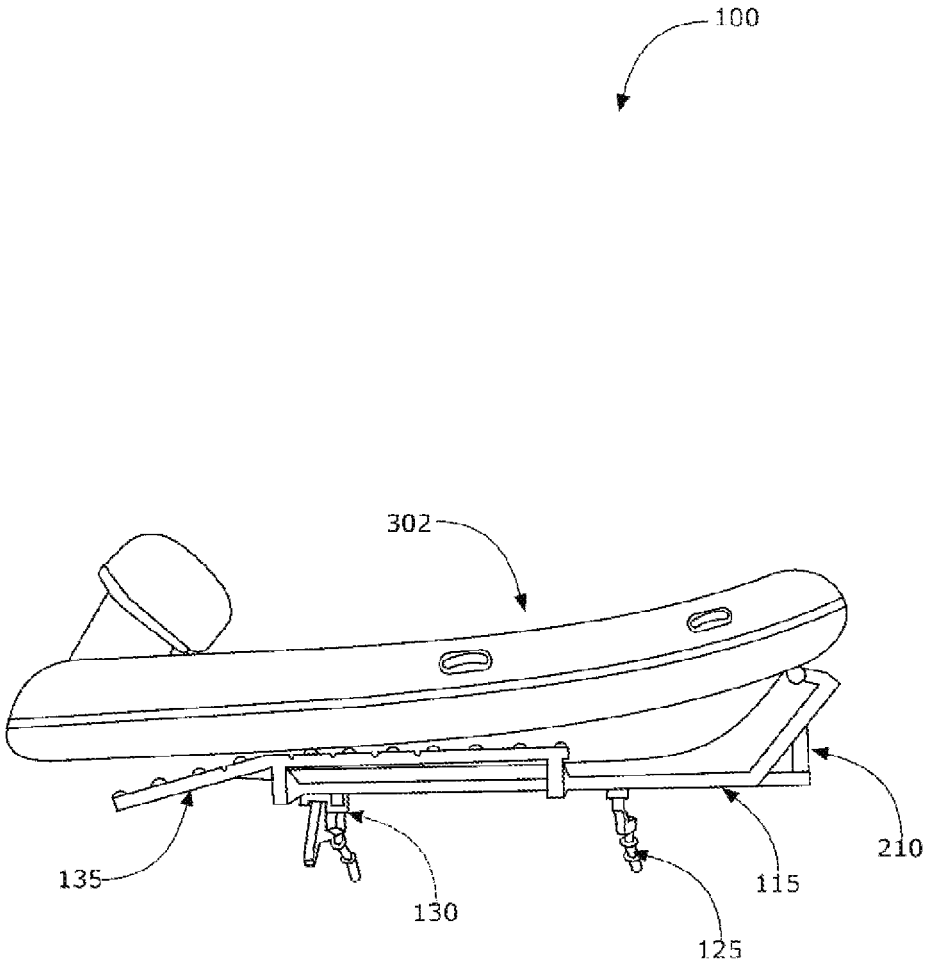
FIG. 4 is a perspective view illustrating the blu water lift system according to an embodiment of the present invention of FIGS. 1-3.

Referring now to FIG. 4, blu water lift system 100 may comprise frame 115, nose tower 210, carriage structure 120, at least one pivot mounting arm 125, electrically-operated actuator 130, and loading ramp 135. Blu water lift system 100 nose tower 210 may comprise at least one horizontal position useful for accommodating variable lengths of varying watercraft 302.

Figure 5:
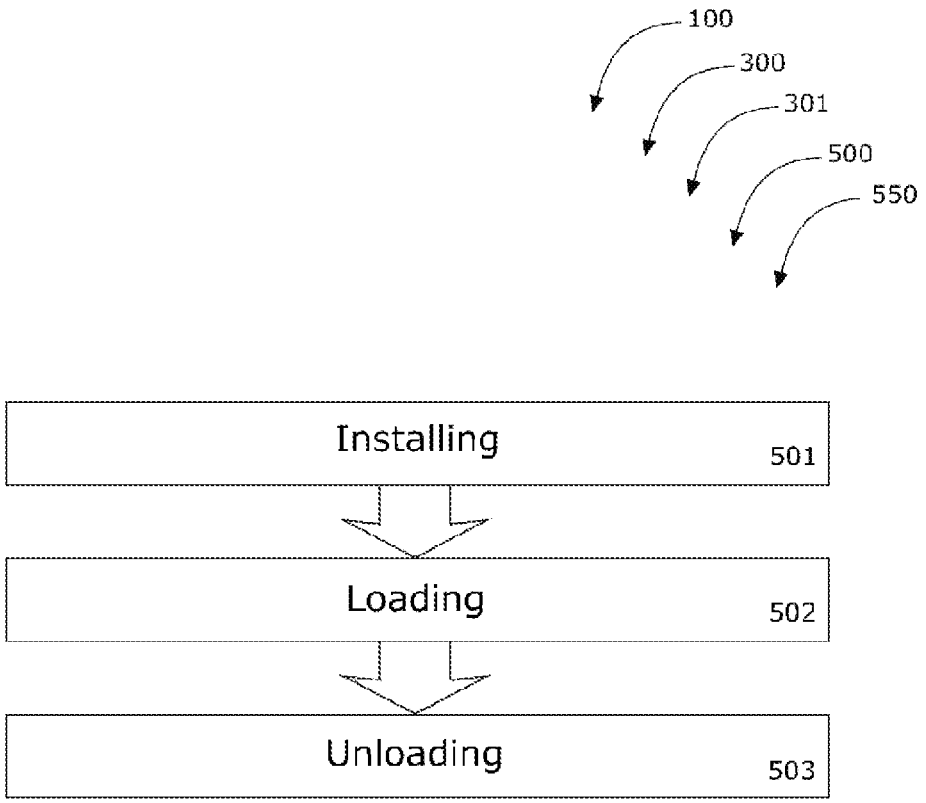
FIG. 5 is a flowchart illustrating a method of use for the blu water lift system according to an embodiment of the present invention of FIGS. 1-4.

Referring now to FIG. 5, method of using 500 blu water lift system 100 comprising steps 550 of step one 501 installing front pivot arm 126 and rear pivot arm 127 of blu water lift system 100 to boat 301, step two 502 loading watercraft 300, and step three 503 unloading watercraft 300.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A personal watercraft lift system comprising:

a personal watercraft lift assembly comprising:

a frame comprising;

a square-beam comprising;

a first-end; and a second-end comprising:

a nose tower; comprising:

a winch receiver;

a hook receiver; and a nose cradle comprising; and at least one cushioned bumper;

a carriage structure comprising;

a hull-resting plate; and
at least one carriage rail; comprising:
a spar comprising;
at least one cushioned roller; and
at least one truss assembly; and
at least one pivot mounting arm comprising;
at least one bracket assembly;
an attachment means; and
an electrically-operated actuator; and
a loading ramp comprising;
a ladder structure; and
a hinged-attacher; and
a remote activator;
wherein said square-beam is defined by said first-end and said second-end and is structured and arranged for providing structure to attach said nose tower and said carriage structure;
wherein said carriage structure comprises said hull-resting plate and said at least one carriage rail are structured and arranged for retaining a hull of a watercraft during an in-transport condition;
wherein said at least one pivot mounting arm and said at least one bracket assembly and said attachment means are structured and arranged for raising and lowering said watercraft;
wherein said loading ramp and said ladder structure and said hinged-attacher are structured and arranged for maneuvering said watercraft to said carriage structure;
wherein said personal watercraft lift assembly is structured and arranged for removably attaching said frame and said carriage structure to said watercraft, operating said at least one pivot mounting arm via said electrically-operated actuator and said remote activator, and operating said loading ramp for manipulating said watercraft between said in-transport condition and a non-transport condition.

2. The personal watercraft lift system of claim 1 wherein said nose tower comprises at least one horizontal position and is structured and arranged for accommodating varying lengths of at least one said watercraft.

3. The personal watercraft lift system of claim 2 wherein said nose cradle comprises at least one cushioned bumper.

4. The personal watercraft lift system of claim 1 wherein said carriage structure comprises a left carriage rail and a right carriage rail.

5. The personal watercraft lift system of claim 1 wherein said ladder structure comprises at least one cushioned roller.

6. The personal watercraft lift system of claim 1 wherein said remote activator comprises system on activation, system off activation, system raise activation, and system lower activation.

7. The personal watercraft lift system of claim 1 wherein said personal watercraft lift assembly comprises corrosion-resistant materials.

8. The personal watercraft lift system of claim 1 wherein said at least one pivot mounting arm comprises a front pivot arm and a rear pivot arm.

9. The personal watercraft lift system of claim 8 wherein said front pivot arm comprises a first rotation mechanism is structured and arranged for providing up to 25 degrees range of vertical motion for said carriage structure.

10. The personal watercraft lift system of claim 8 wherein said rear pivot arm and a second rotation mechanism are structured and arranged for providing up to 25 degrees range of vertical motion for said carriage structure.

11. The personal watercraft lift system of claim 10 wherein said rear pivot arm is structured and arranged for carrying a load of said watercraft.

12. The personal watercraft lift system of claim 1 wherein a remote activator comprises RF operating signal.

13. The personal watercraft lift system of claim 12 wherein said remote activator comprises short-range wireless interconnection operating signal.

14. The personal watercraft lift system of claim 13 wherein said remote activator comprises a mobile device application.

15. A personal watercraft lift system comprising:
a personal watercraft lift assembly comprising:
a frame comprising;
a square-beam comprising;
a first-end; and
a second-end comprising:
a nose tower comprising;
a winch receiver;
a hook receiver; and
a nose cradle comprising; and
at least one cushioned bumper; and
a carriage structure comprising;
a hull-resting plate; and
at least one carriage rail comprising;
a spar comprising;
at least one cushioned roller; and
at least one truss assembly; and
at least one pivot mounting arm comprising;
at least one bracket assembly;
an attachment means; and
an electrically-operated actuator; and
a loading ramp comprising;
a ladder structure comprising;
at least one cushioned roller; and
a hinged-attacher; and
a remote activator comprising;
system on activation;
system off activation;
system raise activation; and
system lower activation;
wherein said personal watercraft lift assembly comprises corrosion-resistant materials;
wherein said square-beam is defined by said first-end and said second-end useful for providing structure to attach said nose tower and said carriage structure;
wherein said nose tower comprises said winch receiver, said hook receiver, and said nose cradle;
wherein said nose tower comprises at least one horizontal position useful for accommodating varying lengths of at least one said watercraft;
wherein said carriage structure comprises said hull-resting plate and said at least one carriage rail useful for retaining a hull of a watercraft during an in-transport condition;
wherein said carriage structure comprises a left carriage rail and a right carriage rail;
wherein said left carriage rail comprises a forward bracket assembly and a rear bracket assembly;
wherein said right carriage rail comprises a forward truss and a rear truss;
wherein said forward truss and said rear truss comprises members in a perpendicular arrangement;
wherein said at least one pivot mounting arm comprises said at least one bracket assembly and said attachment means is useful for raising and lowering said watercraft;

wherein said at least one pivot mounting arm comprises a front pivot arm and a rear pivot arm;

wherein said front pivot arm comprises a first rotation mechanism useful for providing up to 25 degrees range of vertical motion for said carriage structure;

wherein said rear pivot arm comprises a second rotation mechanism useful for providing up to 25 degrees range of vertical motion for said carriage structure;

wherein said loading ramp comprises said ladder structure and said hinged-attacher useful for maneuvering said watercraft to said carriage structure;

wherein said rear pivot arm comprises load-bearing materials suitable for carrying a load of said watercraft;

wherein said ladder structure comprises at least one cushioned roller;

wherein said remote activator comprises said system on activation, said system off activation, said system raise activation, and said system lower activation;

wherein a remote activator comprises RF operating signal; and wherein said personal watercraft lift assembly is useful for removably attaching said frame and said carriage structure to said watercraft, operating said at least one pivot mounting arm via said electrically-operated actuator and said remote activator, and operating said loading ramp for manipulating said watercraft between said in-transport condition and a non-transport condition.

16. The personal watercraft lift system of claim 15 further comprising a kit including:

said personal watercraft lift assembly;

attachment means; and a set of user instructions.

17. A method of using a personal watercraft lift system comprising the steps of:

installing front pivot arm and rear pivot arm of a personal watercraft lift system to a boat;

loading a personal watercraft; and unloading said personal watercraft.

18. The method of claim 17 further comprising the steps of de-installing front pivot arm and rear pivot arm of said personal watercraft lift system.

* * * * *